United States Patent [19]

Clift

[11] 3,987,427

[45] Oct. 19, 1976

[54] DOPPLER DETECTION DEVICE WITH PHASE SHIFT MEANS TO INHIBIT FALSE ALARMS

[75] Inventor: Bruce Graham Clift, Ringwood, Australia

[73] Assignee: Nidac Pty. Limited, Burwood, Australia

[22] Filed: Apr. 23, 1975

[21] Appl. No.: 570,878

[30] Foreign Application Priority Data

Apr. 23, 1974 Australia ..... 7341/74

[52] U.S. Cl. ..... 340/258 A; 343/5 PD

[51] Int. Cl.[2] ..... G08B 13/24; G08B 13/22

[58] Field of Search ..... 340/258 A; 343/5 PD, 343/7.7

[56] References Cited

UNITED STATES PATENTS

| | | | |
|---|---|---|---|
| 3,727,216 | 4/1973 | Antonio | 340/258 A |
| 3,733,581 | 5/1973 | Kalmus | 340/258 A |
| 3,760,400 | 9/1973 | Galvin et al. | 340/258 A |
| 3,863,240 | 1/1975 | Galvin | 343/5 PD |

*Primary Examiner*—Glen R. Swann, III

*Attorney, Agent, or Firm*—Finnegan, Henderson, Farabow & Garrett

[57] ABSTRACT

A Doppler principle detection device includes means for transmitting signals into a field to be protected, means for receiving signals from said field, quadrature mixers for multiplying a reference signal and the received signal to discern between positive and negative Doppler shifts, an integrator for integrating the output of the detection device and an alarm adapted to be activated when the output of the integrator reaches a predetermined threshold level and incorporating a false alarm inhibitor for shifting by 90° the difference in phase of the received signals with respect to the reference signal. In one form the false alarm inhibitor comprises analogue switches connected to a level detector and to an inverter connected to the level detector arranged to switch phase shifted signals to the quadrature mixers to shift the phase of the reference signal by 90°. In an alternative form a digital signal oscillator is connected to a divider and has its phase quadratured outputs switched by a level detector to achieve the same 90° phase shift in the reference signals.

8 Claims, 3 Drawing Figures

DOPPLER DETECTION DEVICE WITH PHASE SHIFT MEANS TO INHIBIT FALSE ALARMS

BACKGROUND OF THE INVENTION

This invention relates to improvements in security devices and more particularly to improvements in electronic detection devices working on the Doppler principle. The invention is applicable to security devices utilising the Doppler principle in which the detection technique employs quadrature mixers to discern between positive and negative Doppler shifts. This technique is common among ultrasonic and radio frequency type Doppler detection devices.

Electronic detection devices utilising the Doppler principle have been widely used for some years. Such devices detect a change in received frequency from transmitted frequency, the difference being the Doppler shift. These devices should ignore spurious signals generated by external environmental influences which alter the received frequency and/or phase, but do not always do so thus resulting in the generation of false alarms.

In the case of frequency discriminating devices of the above type the detector may not be able to discern between (a) small oscillatory noise or vibration sources which cause phase jitter on the received signal and that fall within the pass-band of the receiver and which when combined with the appropriate mean phase of the received signal cause false alarms, and (b) real signals producing either a positive or negative Doppler shift caused by a moving body within the field of the devices.

SUMMARY OF THE INVENTION

It is the object of the invention to provide a detection device capable of discerning between signals generated by phase jitter on the received signal, for example caused by accoustic or mechanical vibrations, and real alarm situation signals.

The invention provides a security device comprising a Doppler principle detection device including means for transmitting signals into a field to be protected, means for receiving signals from said field, quadrature mixers for multiplying a reference signal and said received signal to discern between positive and negative Doppler shifts, an integrator for integrating the output of the detection device and an alarm adapted to be activated when the output of the integrator reaches a predetermined threshold level, characterised by a false alarm inhibitor comprising means activated when the output from the integrator reaches a predetermined signal level lower than said predetermined threshold level for shifting by 90° the difference in phase of the signals received from said field with respect to said reference signal.

Preferably said phase difference shifting means includes a level detector connected to the integrator output and set to a lower level than the alarm threshold level, a switch for switching the phase of one of three signals; the received signal, the transmitted signal or the reference signal. The output from the level detector provides the phase select signal to operate the switch and in so doing the directional sense of the integrator output due to a noise or vibration source is reversed and the integrator fluctuates about one edge of the window level detector.

BRIEF DESCRIPTION OF THE DRAWINGS

Two alternative preferred forms of the invention will now be described with reference to the accompanying drawings in which.

DESCRIPTION OF THE PREFERRED EMBODIMENTS

Figure 1:
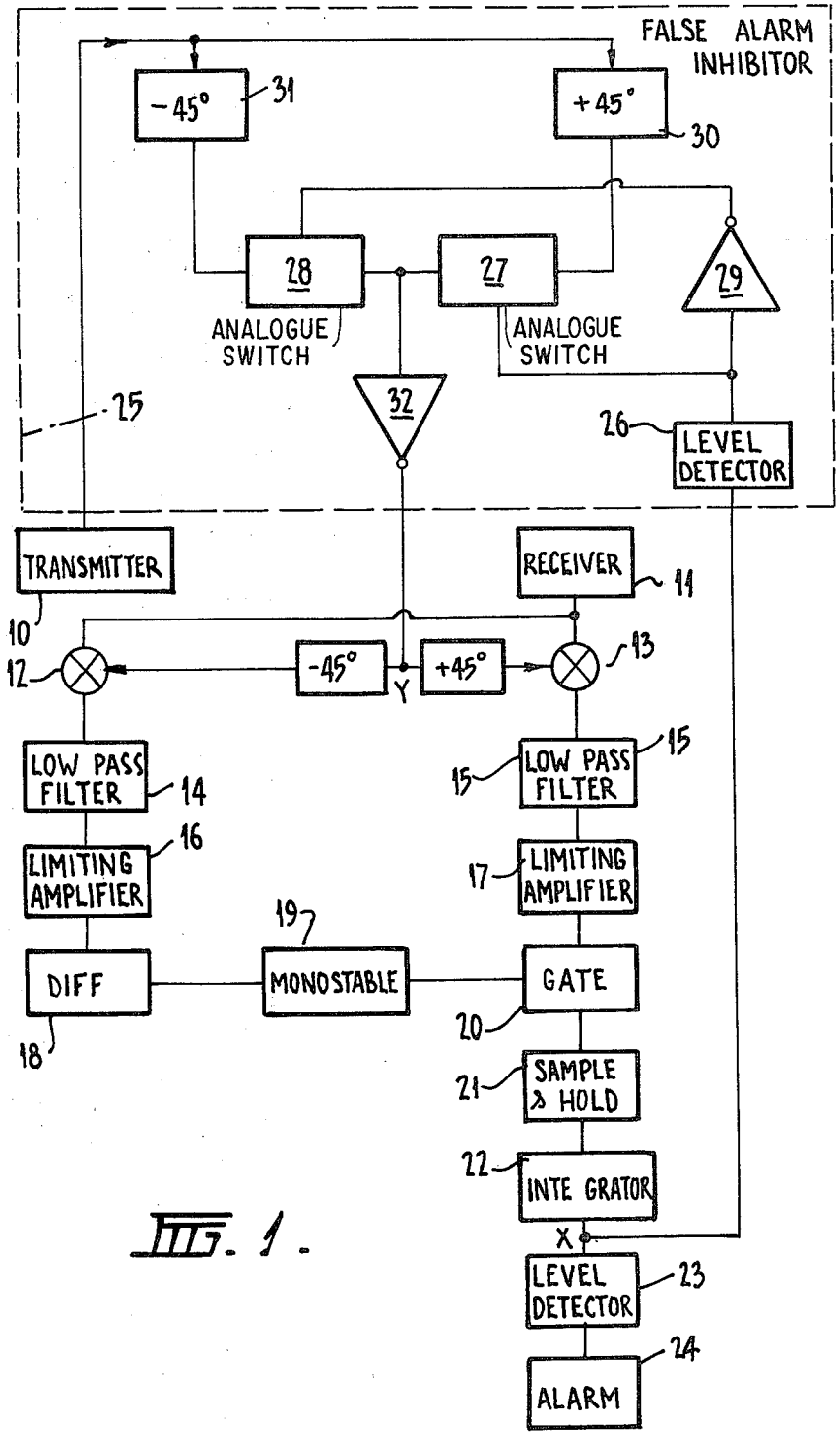
FIG. 1 is a block schematic of an alarm system embodying the invention.

In both preferred forms of the invention, the false alarm inhibitor embodying the invention is applied to a known synchronous ultrasonic Doppler detection device of the type shown in FIG. 1 of the drawings. The device is a "double ended" system: one in which a signal is used to charge and discharge an integrator feeding a level detector adapted to activate an alarm.

The Doppler detector system shown includes a transmitter 10 and a receiver 11 connected to quadrature mixers 12 and 13 which produce Doppler output signals that are passed respectively through low pass filters 14 and 15 and limiting amplifiers 16 and 17 to produce signals which vary in phase with respect to each other by ± 90° as a result of the change in sign of the Doppler shift caused by a moving body within the field of the detector.

The output signal from amplifier 16 is passed through a differentiator 18 to produce positive pulses. These pulses are used to trigger a monostable 19 which produces gating pulses and the gating pulses are applied to gate 20 whereby the output of amplifier 17 is gated to a sample and hold circuit 21 in the form of pulses having a duration T and a period $2\pi/_{Wo}$ where Wo is the Doppler shift. These pulses will be positive or negative depending on the sign of the Doppler shift.

The sample and hold circuit may be formed by a fast charge slow discharge capacitor and this circuit serves to level out the frequency dependance of the signal. The sample and hold circuit 21 is connected to an integrator 22 which is in turn connected to a level detector 23 adapted to activate an alarm 24 when a moving body is detected.

The detection device described above is well known so that further description thereof is not required. As already briefly mentioned such devices are not usually able to discern between sources causing phase jitter and real sources for which an alarm is required.

If there is no Doppler signal and the received signal is the same as the transmitted signal, phase jitter in the received signal will produce an output from 12 and/or 13, depending on the phase relationship between a reference signal and the received signal, thus resulting in a change in output from integrator 22 which may cause the alarm to be activated. This can be shown mathematically as follows:

1. Output from mixer 12: $I = A \text{ Sin } W_r t. B \text{ Sin } W_T t$, wherein $A \text{ Sin } W_r t$ represents the received signal and $B \text{ Sin } W_T t$ represents the transmitted signal.

$$\therefore I = AB/2[\text{Cos}(W_R - W_T)t - \text{Cos}(W_R + W_T)t]$$

The $(W_R + W_T)$ term is removed by the low pass filter and the relevant output becomes:

$$I = AB/2 \text{ Cos } (W_R - W_T)\, t \qquad (1)$$

2. Output from mixer 13: $Q = A \text{ Sin } W_R t.B \text{ Cos } W_T t$ $$\therefore Q = AB/2\, [\text{Sin } (W_R + W_T)\, t + \text{Sin } (W_R - W_T)\, t\,]$$

$(W_R+W_T)$ is removed by the low pass filter 14 and the relevant output becomes:

$$Q = AB/2\text{Sin}\ (W_R-W_T)\ t \qquad (2)$$

I. is positive for $(W_R-W_T) \leq \pm \pi/2$
Q. is positive for $(W_R-W_T) \leq +\pi/2$
and is negative for $(W_R-W_T) \leq -\pi/2$ 3. Consider $W_R=W_T$ with $W_R$ containing phase jitter due to a vibrational noise source within the pass-band of the low pass filters.

Let. A Sin $W_Rt$ = A Sin $(W_Tt + \phi + M \text{ Sin } W_Nt)$

Output from mixer 12 = A Sin $(W_Tt + \phi + M \text{ Sin } W_Nt).B \text{ Sin } W_Tt$ $$I = AB/2 \text{ Cos } (M \text{ Sin } W_Nt + \phi) \qquad (3)$$

Similarly the output from mixer 13

$$Q = AB/2 \text{ Sin } (M \text{ Sin } W_Nt + \phi) \qquad (4)$$

where M = modulation index $\Delta W_T/W_N$
$WN$ = angular noise interference frequency.
$\phi$ = phase difference between $W_R$ and $W_T$ It can be seen from equations (3) and (4) that the I and Q outputs will contain $W_N$ with a difference in phase of 90°. It can be shown that the sense of the output varies as a function of $\phi$; i.e. when $$(a)\ M \text{ Sin } W_Nt + \phi = 0,\ Q = 0,\ I = +\frac{AB}{2}$$

$$(b)\ M \text{ Sin } W_Nt + \phi = \frac{\pi}{4},\ Q = I = +\frac{\sqrt{2}}{4}A \cdot B$$

$$(c)\ M \text{ Sin } W_Nt + \phi = \frac{\pi}{2},\ A = +\frac{AB}{2},\ I = 0$$

$$(d)\ M \text{ Sin } W_Nt + \phi = \frac{3\pi}{4},\ Q = +\frac{\sqrt{2}}{4}AB,\ I = -\frac{\sqrt{2}}{4}AB$$

$$(e)\ M \text{ Sin } W_Nt + \phi = \pi,\ Q = 0,\ I = \frac{-AB}{2}$$

When I or Q=0 no output results since in the system one channel gates the other. Therefore it can be seen from (b) and (d) that a change of 90° in phase of $W_R$ with respect to the mixer injection signal will result in a reversal of sense on the output. Thus, in accordance with the invention, the detection device so far described has connected thereto a false alarm inhibitor, such as 25, adapted to shift the difference in phase between the received signal and the reference signal by 90°.

As shown in block form in FIG. 1, the false alarm inhibitor 25 comprises a level detector 26 connected to the output of integrator 22 at X, a pair of analogue switches 27 and 28 connected to the level detector 26 and to the output of an inverter 29 respectively so that complementary outputs are applied to the analogue switches 27, 28. The oscillator in the transmitter 10 is connected to ± 45° phase shift networks 30 and 31 which are in turn connected to the analogue switches 27 and 28. The outputs of the switches 27 and 28 are alternatively connected via a buffer amplifier 32 to the quadrature mixers 12 and 13.

Figure 2:
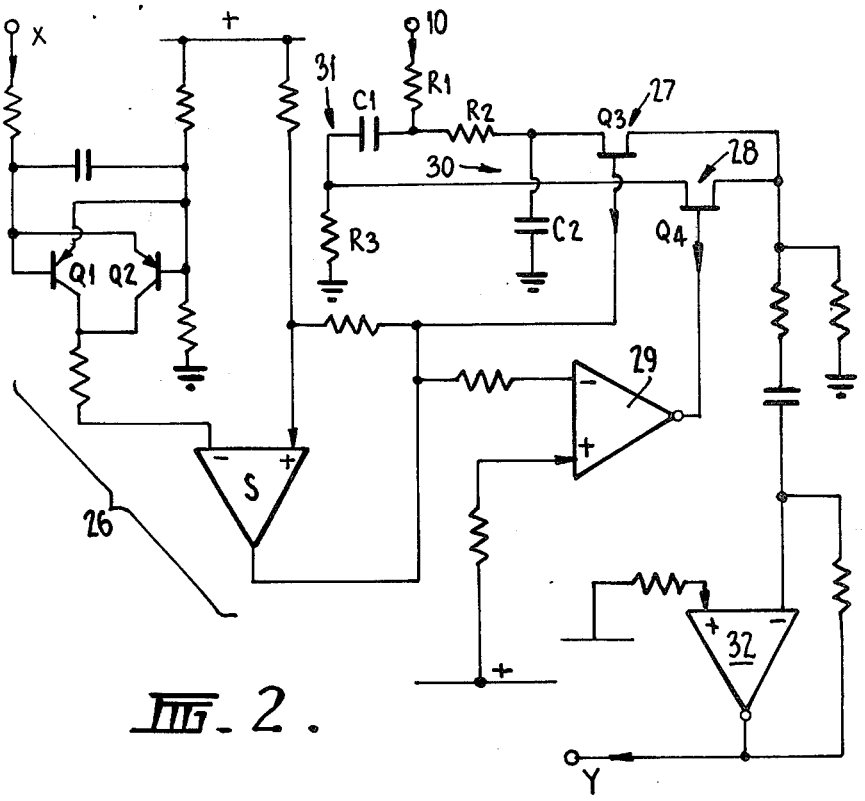
FIG. 2 is a circuit diagram of one specific form of false alarm inhibitor embodying the invention.
Figure 3:
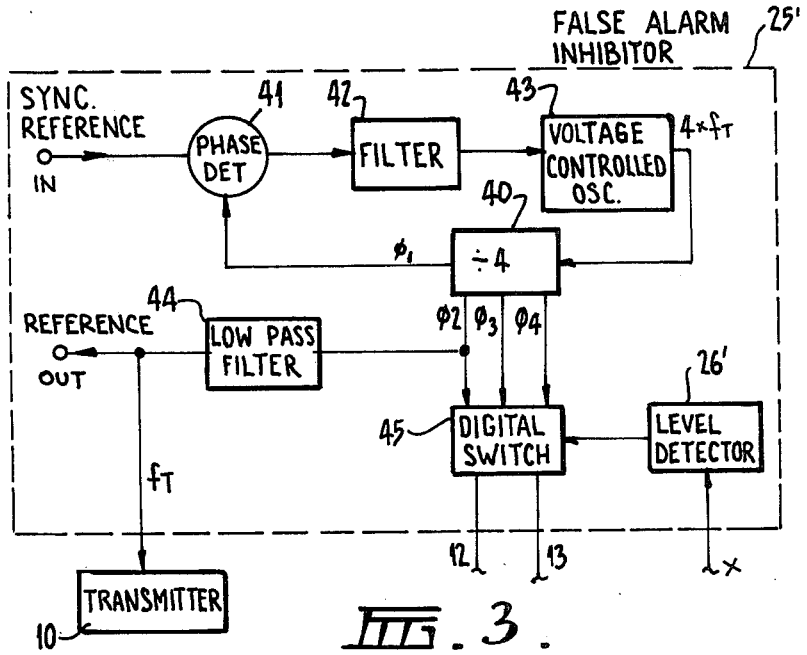
FIG. 3 is a block schematic of an alternative form of false alarm inhibitor embodying the invention.

The preferred form of circuitry for the inhibitor 25 is shown in detail in the circuit diagram of FIG. 2. In this form level detector 26 comprises a voltage window consisting of two transistors Q1 and Q2, the window being such that a change in output from integrator 22 of ± 0.5 volt causes the collector of Q1 or Q2 to turn on. This signal is applied to a Schmitt trigger S which produces a clean switching signal with a small amount of hysteresis. A complementary output is obtained from the inverter amplifier 29 and the complementary outputs are used to operate the analog switches 27, 28 comprising P channel junction field effect transistors Q3 and Q4. The phase shift networks 30, 31 are formed by R2, C2 and C1, R3 respectively and these operate to shift the phase of the reference signal by ± 45°, and depending on the conduction states of Q3 and Q4 either phase is applied to the buffer amplifier 32. The buffer amplifier provides amplification of the signal and a low drive impedance for the following ± 45° phase shift networks driving the mixers 12 and 13.

It will be clear from the above description that if any phase jitter is included in the received signal, the output of integrator 22 may exceed the voltage window of level detector 26 causing complementary signals to open the previously closed one of analogue switches 27 and 28 and close the other thereby applying to phase shift networks of the quadrature mixers 12 and 13 the reference signal, derived from the transmitter oscillator, that is phase shifted through 90° with respect to the received signal. In this way the directional sense of the integrator output due to the interfering source is reversed and the integrator output will fluctuate about the relevant level of the detector 26 until the interfering source is removed. However, in a real signal situation, the frequency of the received signal changes and the operation of the phase switch cannot affect the output of integrator 22 and the alarm 24 will be activated.

In the alternative form of the invention shown in FIG. 4, the false alarm inhibitor 25' is connected to the mixers 12 and 13 and to the output of integrator 22 at X as indicated. The inhibitor in this case works in a digital mode rather than in an analogue mode as in the previous case. The inhibitor comprises a ÷ 4 network 40, such as two cross-coupled type 4027 master-slave flip-flops, connected in a phase-locked loop comprising a phase detector 41, a filter 42 and a voltage controlled oscillator 43 operating to produce a digital signal input to the divider 40 of four times the desired transmitter frequency $f_T$. The phase-locked loop may comprise a National LM565.

The above arrangement utilises the property that a digital signal when divided by four produces four quadrature phased signals, in this case at the desired frequency $f_T$. The first signal $\phi_1$ is used as the reference signal for the phase-locked loop. The second signal $\phi_2$ is used to drive the transmitter 10, through a low pass filter 44 providing an approximate sinusoidal transducer driving signal. Any one of the signals could be used for either of these purposes. Signals $\phi_2$, $\phi_3$ and $\phi_4$, or any other three of the four signals, are connected via a digital switch 45 to the inputs of mixers 12 and 13 to provide both the necessary 90° phase difference in the mixer injection signals and the further 90° shift for inhibiting false alarms as described above and as determined by level detector 26' which may be identical to the detector 26 already described. The digital switch may comprise two type 4011 quad two input NAND gates or any other suitable 2×2 bit multiplexer.

It will be self-evident that when phase jitter causes the output of integrator 22 to exceed the level of detector 26', the digital switch is actuated to switch one of the three phase quadratured signals from ÷ 4 network to the mixers 12, 13 to thereby shift the phase of the signal to the mixers by 90° relative to the receiver signal changing the sense of the integrator output as before.

One of the advantages of using the phase-locked loop is that the system is capable of being locked to a reference signal derived from another similar detector operating in the same area. With the two or more detectors locked in this way, the transmitted signals do not interfere thus avoiding false alarms from this interference source.

In either of the above embodiments, the commercial form of the alarm is conveniently combined with the false alarm inhibitor described in copending application No. 561,890 entitled "Improvements in Electronic Detection Devices" the disclosure of which is incorporated herein by cross reference. In such an arrangement a common inhibitor level detector is used and the alarm level detector operates at ± 2.5V as in the copending application. Where the phase switch of the present invention is used alone, the difference in detector levels need not be so great as any difference is sufficient for the purpose of this invention. With both the phase jitter protection of the present invention and the random frequency protection of the copending invention, the resulting alarm is rendered substantially false alarm free.

I claim:

1. A security device comprising a Doppler principle detection device including means for transmitting signals into a field to be protected, means for receiving signals from said field, quadrature mixers for multiplying a reference signal and said received signal to discern between positive and negative Doppler shifts, an integrator for integrating the output of the detection device and an alarm adapted to be activated when the output of the integrator reaches a predetermined threshold level, characterised by a false alarm inhibitor comprising means activated when the output from the integrator reaches a predetermined signal level lower than said predetermined threshold level for shifting by 90° the difference in phase of the signals received from said field with respect to said reference signal.

2. The device of claim 1, wherein said phase difference shifting means includes a level detector connected to the output of said integrator, and switch means responsive to the detection of said predetermined signal level by said level detector for changing the phase of said reference signal with respect to said received signals.

3. The device of claim 2, wherein said switch means includes a digital switch activated by said level detector, a digital signal oscillator connected to a divider adapted to produce at least three output signals in phase quadrature and of the same frequency as that of the transmitted signals, said digital switch operating to connect two of said output signals in phase quadrature to said mixers to provide said reference signals and being actuated by said level detector each time said predetermined signal level is detected to shift the phase of said signals by 90° with respect to said received signals.

4. The device of claim 3, wherein one of said output signals of said divider is used to drive the means for transmitting signals into said field, said one of said outputs being passed through a filter so that the digital signal is rendered substantially sinusoidal.

5. The device of =3, wherein said divider forms part results a phase-locked loop including said digital signal oscillator, said divider, a phase detector and a filter.

6. The device of claim 2, further including an inverter connected to said level detector, wherein said switch means includes a pair of analogue switches respectively connected to said level detector and to said inverter, plus and minus 45° phase shift networks respectively connected to said analogue switches and each connected to said reference signal, the arrangement being such that each time the level detector detects said predetermined signal level, the states of the analogue switches are changed so as to apply a 90° phase shift to the reference signal.

7. The device of claim 6, wherein said level detector includes circuit means defining a voltage window and having its output connected to a Schmitt trigger having a small amount of hysteresis.

8. The device of claim 1 further including means for sampling the integrator output and for resetting the integrator if the output does not reach said predetermined threshold level within a predetermined time after reaching said predetermined signal.

* * * * *

UNITED STATES PATENT OFFICE

CERTIFICATE OF CORRECTION

Patent No. 3,987,427 Dated OCTOBER 19, 1976

Inventor(s) BRUCE GRAHAM CLIFT

It is certified that error appears in the above-identified patent and that said Letters Patent are hereby corrected as shown below:

Column 6,

Claim 5, line 1, "=3" should read --claim 3--.

Signed and Sealed this

Twenty-second Day of February 1977

[SEAL]

*Attest:*

RUTH C. MASON
*Attesting Officer*

C. MARSHALL DANN
*Commissioner of Patents and Trademarks*